US006935230B1

(12) United States Patent
Walker et al.

(10) Patent No.: US 6,935,230 B1
(45) Date of Patent: Aug. 30, 2005

(54) LIQUID COATING APPLICATOR AND PRINTING SYSTEM WITH INK ACTIVATOR SPRAYER

(75) Inventors: Jeffery W. Walker, Columbus, GA (US); J. Patrick Epling, Cataula, GA (US)

(73) Assignee: Immersion Graphics Corporation, Columbus, GA (US)

( * ) Notice: Subject to any disclaimer, the term of this patent is extended or adjusted under 35 U.S.C. 154(b) by 575 days.

(21) Appl. No.: 09/569,645

(22) Filed: May 12, 2000

(51) Int. Cl.[7] ..... B41D 7/00
(52) U.S. Cl. ..... 101/33
(58) Field of Search ..... 101/33, 34

(56) References Cited

U.S. PATENT DOCUMENTS

| | | | | |
|---|---|---|---|---|
| 1,893,785 A | | 1/1933 | Reese | |
| 3,529,611 A | * | 9/1970 | Daum et al. | 134/112 |
| 3,604,434 A | * | 9/1971 | Hurst | 104/93 |
| 3,607,527 A | | 9/1971 | Morley | 156/238 |
| 3,671,288 A | | 6/1972 | Rosenberg | 117/39 |
| 3,693,899 A | * | 9/1972 | Burgess et al. | 242/481.1 |
| 3,796,618 A | | 3/1974 | Lehming et al. | 156/89 |
| 3,867,173 A | | 2/1975 | Putzer | 117/39 |
| 4,010,057 A | | 3/1977 | Nakanisyi | 156/384 |
| 4,229,239 A | | 10/1980 | Arai et al. | 156/155 |
| 4,231,829 A | | 11/1980 | Marui et al. | 156/230 |
| 4,269,650 A | | 5/1981 | Arai et al. | 156/540 |
| 4,348,246 A | | 9/1982 | Nakanishi | 156/73.1 |
| 4,388,866 A | | 6/1983 | Nakanishi | 101/426 |
| 4,407,881 A | | 10/1983 | Shima et al. | 428/156 |
| 4,436,571 A | | 3/1984 | Nakanishi | 156/384 |
| 4,490,413 A | | 12/1984 | Stimson | 427/262 |
| 4,846,368 A | | 7/1989 | Goetz | 222/3 |
| 4,886,293 A | | 12/1989 | Weiler et al. | 280/736 |
| 4,933,016 A | * | 6/1990 | Carlson | 134/18 |
| 5,054,811 A | | 10/1991 | Unterforsthuber et al. | 280/742 |
| 5,197,673 A | | 3/1993 | Sullivan | 239/102.1 |
| 5,226,436 A | * | 7/1993 | Kirby | 134/123 |
| 5,266,141 A | | 11/1993 | Seailles et al. | 156/230 |
| 5,695,587 A | | 12/1997 | Dumoux | 156/230 |
| 5,807,456 A | | 9/1998 | Kaule | 156/230 |
| 5,908,525 A | | 6/1999 | Zaher | 156/230 |
| 5,916,400 A | | 6/1999 | Zaher | 156/230 |
| 6,001,206 A | | 12/1999 | Zaher | 156/230 |

FOREIGN PATENT DOCUMENTS

| | | |
|---|---|---|
| EP | 0 424 258 A1 | 4/1991 |
| EP | 0 726 170 A1 | 8/1996 |
| FR | 2 645 077 | 10/1990 |
| GB | 1125458 | 8/1968 |
| WO | WO 91/13114 | 9/1991 |
| WO | WO 92/10926 | 7/1992 |

* cited by examiner

*Primary Examiner*—Ren Yan
(74) *Attorney, Agent, or Firm*—Sutherland Asbill & Brennan LLP

(57) ABSTRACT

A liquid coating applicator for applying a liquid coating to an object comprising a cantilever comprising a mounting member and a projecting member extending from the mounting member to a distal end. A printing system for printing an image with ink activated with a liquid activator comprises a support for holding a sheet printed with the ink image and a cantilever comprising a mounting member and a projecting member extending from the mounting member to a distal end, an activator sprayer mounted to the projecting member and a reciprocator for shifting the sprayer back and forth so that the activator can be sprayed on the ink image with the activator sprayer while the support holds the ink image.

18 Claims, 5 Drawing Sheets

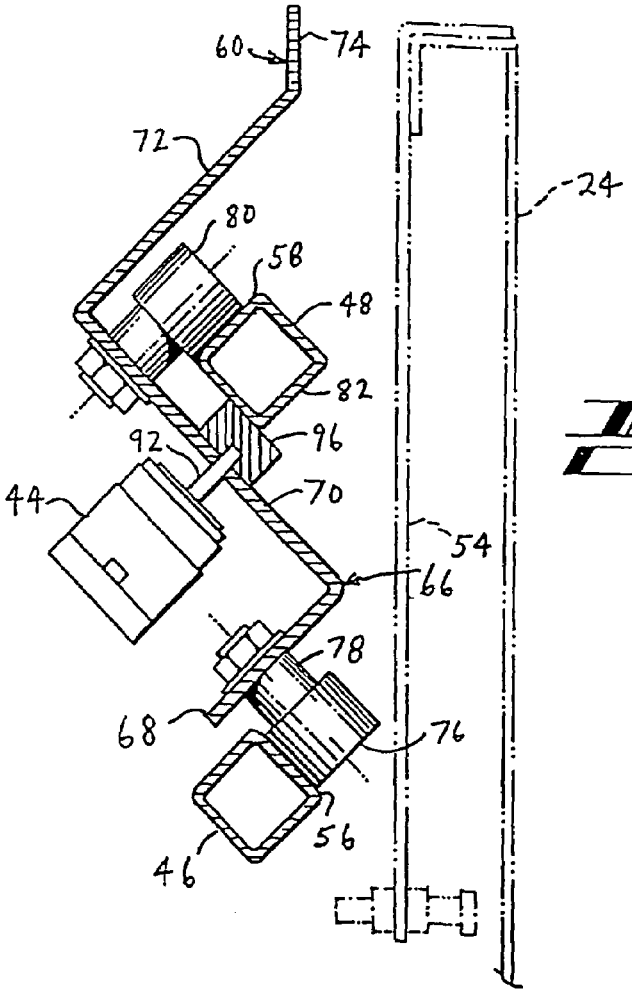
Fig. 4
Fig. 3
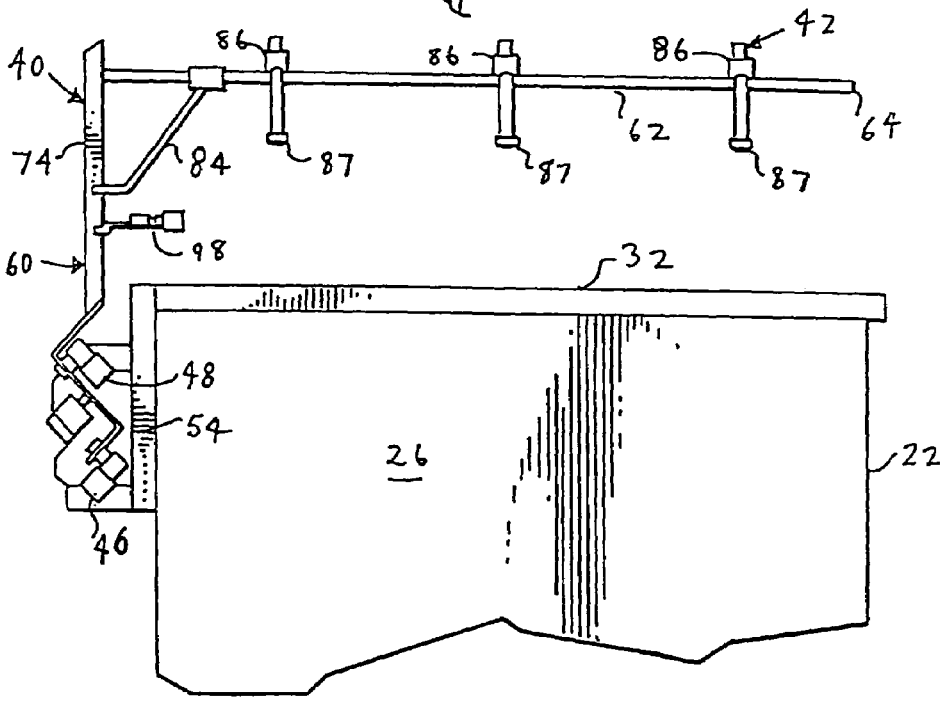

LIQUID COATING APPLICATOR AND PRINTING SYSTEM WITH INK ACTIVATOR SPRAYER

FIELD OF THE INVENTION

This invention generally relates to coating with liquid spraying. More particularly, this invention relates to printing with ink that requires an activator, and even more particularly, relates to transfer printing systems.

BACKGROUND OF THE INVENTION

Printing with ink sometimes requires application of a liquid spray to an ink image to complete the printing or finishing process. For example, in dip transfer printing, a pattern is printed in solvent based ink on a water soluble film such as polyvinyl acetate. The printed film is then placed on the surface of water in a dipping tank with the printed side up and the soluble film side down. The water dissolves the water soluble film while a solvent activator, such as xylene, is sprayed from the sprayer over the printed solvent based ink image. The printed image then becomes fluid and the object to be printed is dipped into the water in the dipping tank through the floating printed ink image. The ink adheres to the object immediately and the object is removed from the tank and dried. The result is a seamless print on the object.

Applying the liquid solvent activator uniformly to the ink image at an appropriate rate produces a high quality transfer printing. Too much activator blurs the ink images and, without enough activator, the ink image will not adhere to the surface of the object being printed.

Liquid solvent activator has been applied to ink images in dip transfer printing with hand held sprayers and with spray nozzles carried on a bar which extends across the top of a dipping tank. The bar carrying the spray nozzles travels back and forth along the length of the bath. The bar is carried on wheels at each end of the bar. The wheels ride along both sides of the bath on tracks. The wheels of such an applicator sometimes bind and slow or even stop the applicator. As a result, the applicator applies liquid activator nonuniformly and the resulting coating is nonuniform. Hand held sprayers apply liquid activator only if the operator is very skilled. There are similar problems with applying other liquid coatings such as varnish or lacquer top coatings.

Accordingly, there is a need for a liquid coating applicator that applies liquid uniformly and there is a particular need for a printing system for an activator applicator that applies activator uniformly to an ink image.

SUMMARY OF THE INVENTION

This invention solves the above-described problem in the art by providing a liquid coating applicator for applying a liquid coating to an object, the applicator comprising a cantilever comprising a mounting member and a projecting member extending from the mounting member to a distal end, a liquid sprayer mounted to the projecting member, and a reciprocator for shifting the sprayer back and forth over the object so that the liquid can be sprayed on the object with the liquid sprayer. This applicator is suitable for applying a variety of liquid coatings such as printing ink activators and top coats such as varnish or lacquer.

More particularly, this invention encompasses a printing system for printing an image with ink activated with liquid activator comprising a support for holding a sheet printed with ink image and an activator applicator including a cantilever, an activator sprayer, and a reciprocator for shifting the sprayer back and forth over the support. The cantilever comprises a mounting member and a projecting member extending from the mounting member to a distal end. The activator sprayer is mounted to the projecting member and the reciprocator shifts the sprayer back and forth over the support so that the activator can be sprayed on the ink image with the activator sprayer while the support holds the ink image. The cantilever allows the sprayer to shift smoothly back and forth over the support without binding so that the sprayer applies the activator uniformly.

According to one embodiment, the reciprocator shifts the cantilever back and forth. More specifically, the reciprocator comprises a track and a carriage engaged with the track. The carriage is connected to the mounting member of the cantilever such that the carriage can travel back and forth on the track while carrying the cantilever. Desirably, the reciprocator comprises a driver, such as a rodless pneumatic cylinder, for moving the carriage back and forth on the track.

According to another embodiment, the projecting member of the cantilever is a telescoping rod and the reciprocator comprises an actuator for selectively expanding and alternatively contracting the telescoping rod and thereby shifting the sprayer back and forth over the support.

According to still another embodiment, the projecting member of the cantilever has a track extending along the length of the projecting member and the reciprocator comprises a carriage connected to the sprayer and engaged with the track such that the carriage can travel back and forth on the track while carrying the sprayer.

The printing system of this invention desirably comprises a tank for holding a dipping liquid such that the printed sheet can float on a surface of the dipping liquid while the sprayer sprays activator on the ink image. Alternatively, the support may comprise a table having a hard surface for holding a printed sheet and printing systems other than dip transfer printing systems.

Other features, objects, and advantages of this invention will be appreciated from the following detailed description of embodiments, drawings and claims.

BRIEF DESCRIPTION OF DRAWINGS

FIG. 3 is an end elevation view of the printing system illustrated in FIG. 1.

FIG. 4 is a partial sectional view of an activator sprayer transport which is a component of the printing system illustrated in FIG. 1.

DETAILED DESCRIPTION OF EMBODIMENTS

As summarized above, this invention encompasses a system for printing with ink which requires an activator, such as a liquid solvent, for final transfer of the ink to an object. This invention is particularly suited for use in dip transfer printing, but is also useful in other types of printing processes wherein an activator is applied to an ink image. Several embodiments of this invention are described below. As will be appreciated by those skilled in the art, these embodiments are adaptable for applying other types of liquid coatings including top coats such as varnish or lacquer.

Figure 1:
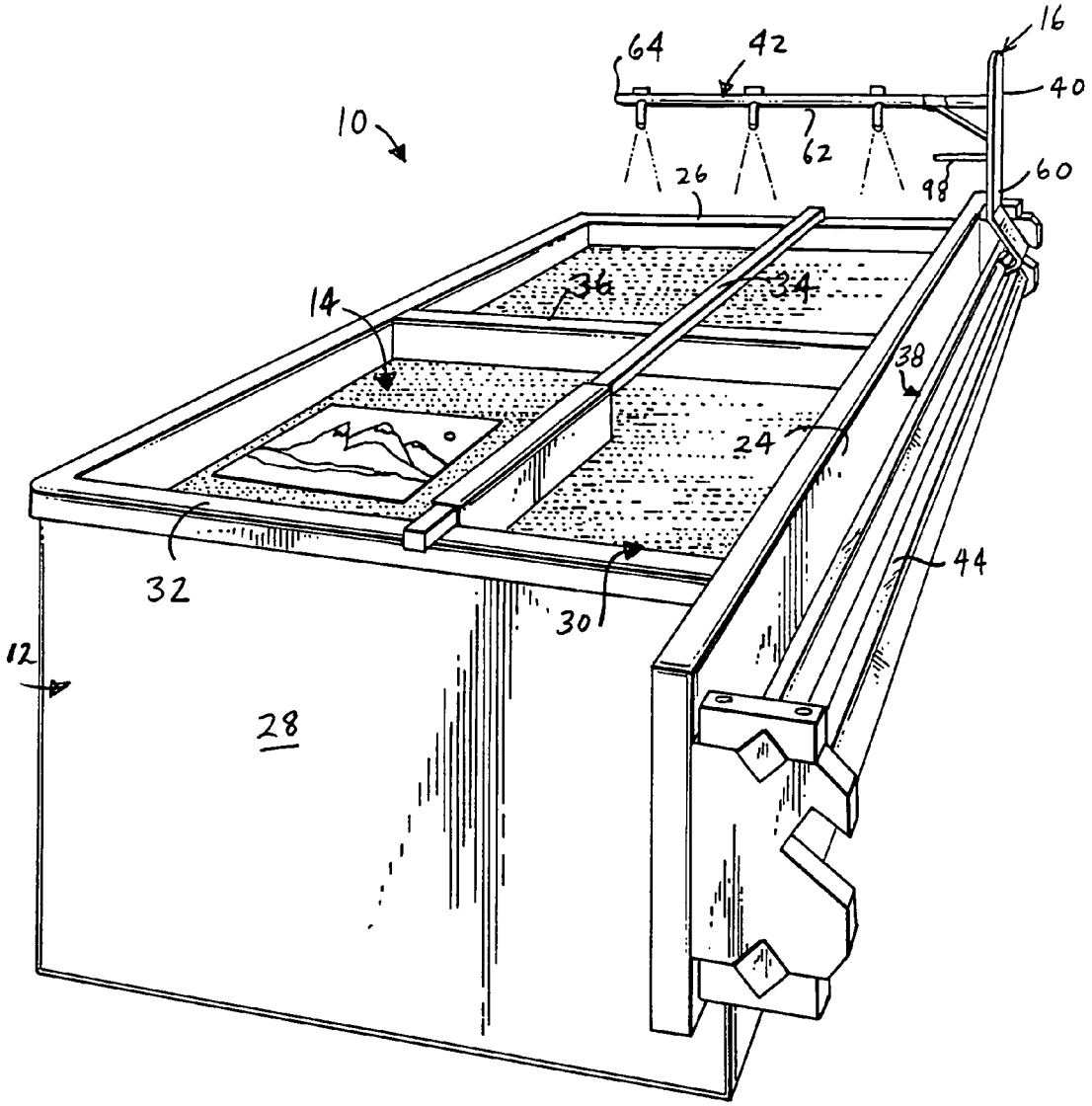
FIG. 1 is a perspective view of dip transfer printing system made in accordance with an embodiment of this invention.

FIG. 1 illustrates a dip transfer printing system 10 made in accordance with an embodiment of this invention and generally includes a dip tank 12 for holding water 14 and an activator applicator 16. The water 14 in the dip tank supports a sheet printed with an ink image and the activator applicator 16 applies activator to the ink image before final transfer of the ink image to an object.

The dip tank 12 has a rectangular cross-section and rests on feet 18 extending from a bottom panel 20. Side panels 22 and 24 and end panels 26 and 28 extend upwardly from the bottom panel 20 and define a rectangular open top 30 surrounded by rim 32. The tank 12 is deep enough to allow an object to be dipped into the tank and printed via dip transfer printing without the object impacting the bottom or sides of the tank. Dividing bars 34 and 36 are positionable across the top 30 of the tank for dividing the surface of the water 14 of the tank into different sections for isolating printed sheets floating on the water in the tank.

Figure 2:
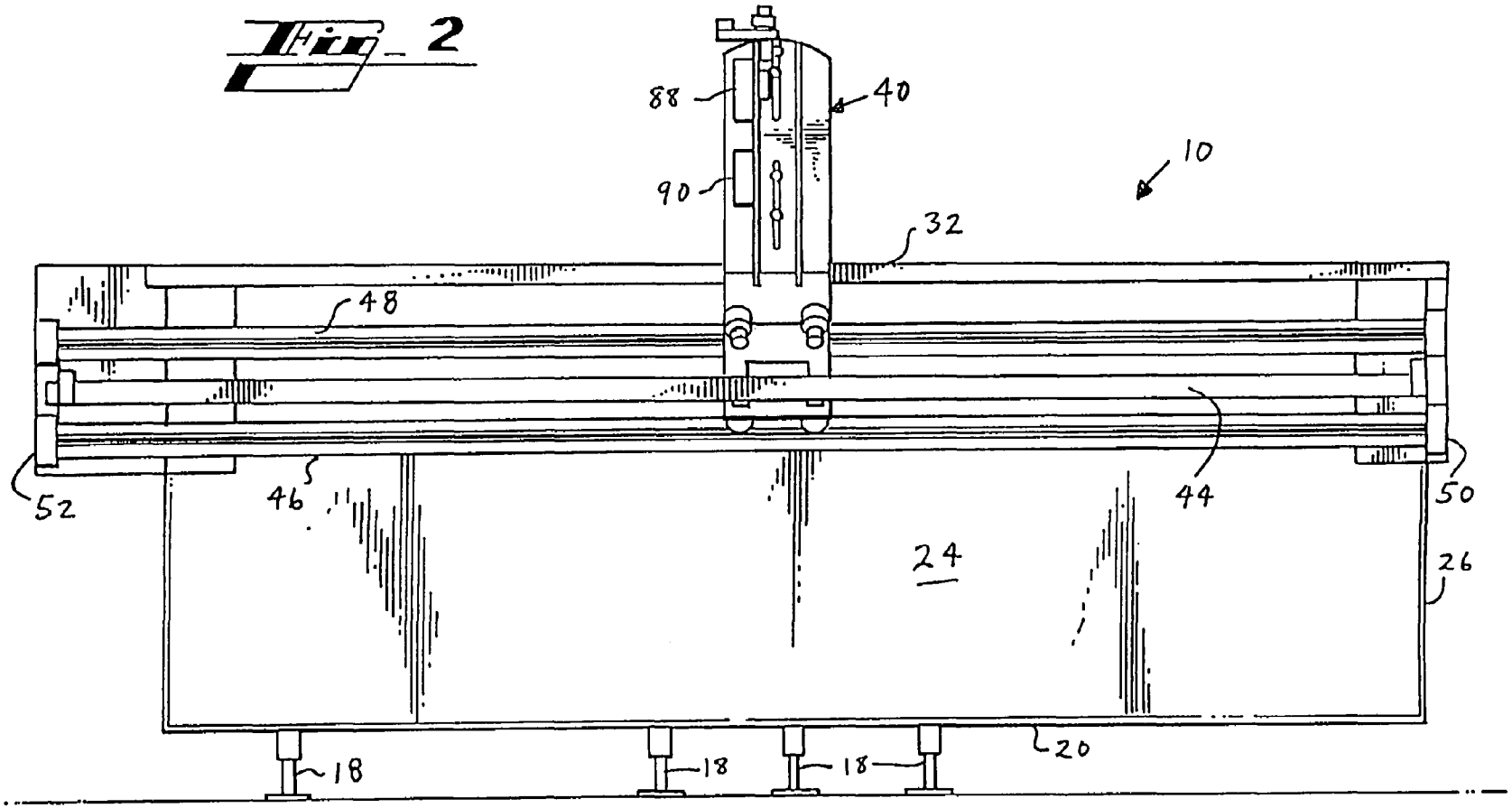
FIG. 2 is a side elevation view of the printing system illustrated in FIG. 1.

As shown in FIGS. 2–4, the activator applicator 16 generally comprises a track 38 extending along one side panel 24 of the dip tank 12, a cantilever transport 40 engaged with the track, a sprayer 42 mounted to the cantilever for applying activator, and a rodless pneumatic cylinder 44 for driving the cantilever transport along the track. As will be explained in more detail below, the cantilever arrangement of the activator applicator 16 provides a smooth, controllable transport for the activator sprayer 42. This arrangement provides superior control for activator application because it travels smoothly without binding and is easily controlled for providing appropriate amounts of activator to the ink image and applying the activator more uniformly. The result is more consistently high quality printing.

The track 38 of the activator applicator 16 comprises a pair of parallel, spaced bars 46 and 48 extending along the one side panel 24 of the dip tank 12 between mounting blocks 50 and 52. The mounting blocks 50 and 52 are secured to the rim 32 of the dip tank 12 with a bracket 54 which extends downwardly from the rim along the exterior of the dip tank. The parallel bars 46 and 48 of the track 38 desirably have at least one flat surface 56 and 58 and, in FIG. 4, the parallel bars have a square cross-section with the four flat sides angled with respect to the adjacent side panel 24 of the dipping tank 12.

The cantilever transport 40 comprises a mounting member 60 engaged with the track 38 for reciprocating movement along the track and a projecting member 62 extending from the mounting member above the track and over the open top 30 of the dip tank 12 to a free distal end 64.

The mounting member 60 of the cantilever transport 40 includes an S-shaped portion 66 for engaging the track 38. The S-shaped portion 66 comprises a lower panel 68 extending diagonally and upwardly toward the dip tank, a middle panel 70 extending diagonally and outwardly from the lower panel, and an upper panel 72 extending diagonally and inwardly toward the dip tank from the middle panel. A vertical portion 74 extends vertically upwardly from the upper panel 72 to the projecting member 62. The mounting member 60 also includes a first wheel 76 rotably mounted to the lower panel 68 with a hub 78 and a second wheel 80 rotably mounted to the middle panel 70 of the mounting member with another hub 82. The first wheel 76 is arranged to travel along the flat surface 56 of the first parallel bar 46 of the track 38 and the second wheel 80 is arranged so as to travel along the flat surface 58 of the second parallel bar 48 of the track. The wheels 76 and 80 are arranged so that they carry the weight of the cantilever transport 40 as the cantilever transport travels back and forth along the track 38.

A support rod 84 extends from the vertical portion 74 of the mounting member 60 to the projecting member 62 for stabilizing the projecting member.

The sprayer 42 of the activator applicator 16 includes a plurality of spray heads 86 mounted to and spaced along the projecting member 62 of the cantilever transport 40. The spray heads 86 are arranged so that nozzles 87 are directed downwardly for spraying activator onto the ink image floating on water in the dip tank 12. Liquid activator is fed under a hydraulic pressure through tubing (not shown) to a manifold 88 mounted to the mounting member 60 of the cantilever transport 40 and then through additional tubing to the spray heads 86. Pressurized air for pneumatic control of the spray heads is fed through another manifold 90 mounted to the mounting member 60 and then to the spray heads 86 through flexible tubing. The spray heads 86 could also be electrically activated. The spray heads and nozzles 87 are sized and arranged so as to uniformly apply an appropriate amount of activtaor to the ink image to the dip tank 12 at an appropriate rate.

As best shown in FIG. 4, the rodless pneumatic cylinder 44 includes a connector 92 which engages the middle panel 70 of the cantilever transport mounting member 60 and connects to a Teflon slide block 96 which fits between the middle panel of the mounting member and the second bar 48 of the track 38. Pressurized air is supplied to each end of the rodless pneumatic cylinder 44 and drives the connector 92 and the cantilever transport 40 back and forth along the track 38.

A position sensor 98 extends from the mounting member 60 below the projecting member 62 for sensing the position of the cantilever transport 40 relative to the dip tank 12. The position sensor 98 sends a signal to a controller for controlling the movement and position of the cantilever transport. The design of the control system for the printing system 10 is well within ordinary skill and is not described herein in detail. Generally described, the control system is set to control the speed and position of the cantilever transport 40 and the rate of delivery of liquid activator through the nozzles 87 of the spray heads 86.

The operation of the printing system 10 is as follows. First, the dip tank 12 is filled with water and the speed of the cantilever transport 40 and the rate of liquid activator delivery through the spray heads 86 are set. A sheet of water soluble film, such as polyvinyl acetate, is printed with an organic solvent ink and then placed ink side up and water soluble film side down onto the surface of water in the dipping tank 12. The cantilever transport 40 then travels along the track 38 over the dipping tank 12 and sprays activator on the organic solvent ink image. The activator, which is an organic solvent such as xylene, dissolves and liquefies the ink image. An object to be printed is then dipped through the liquefied ink image into the water in the dipping tank and removed. The ink in the dipping tank wraps around and adheres to the object as the object is dipped into the tank through the ink image. Any remaining water soluble film is washed off of the object and the printed object is then allowed to dry. The object may then be coated with a protective top coat such as a lacquer, if desired.

The track 38 and the cantilever transport 40 arrangement provides for a smoother and steady movement of the sprayer 42 back and forth along the dip tank 12. Because there is only a single track 38 and the weight of the cantilever transport 40 and sprayer 42 rests on the wheels of the cantilever transport, the activator applicator 16 travels smoothly and uniformly and does not bind.

Although the printing system 10 described above is a dip printing system, this invention encompasses other transfer printing processes including the use of water-based inks and activators.

Figure 5:
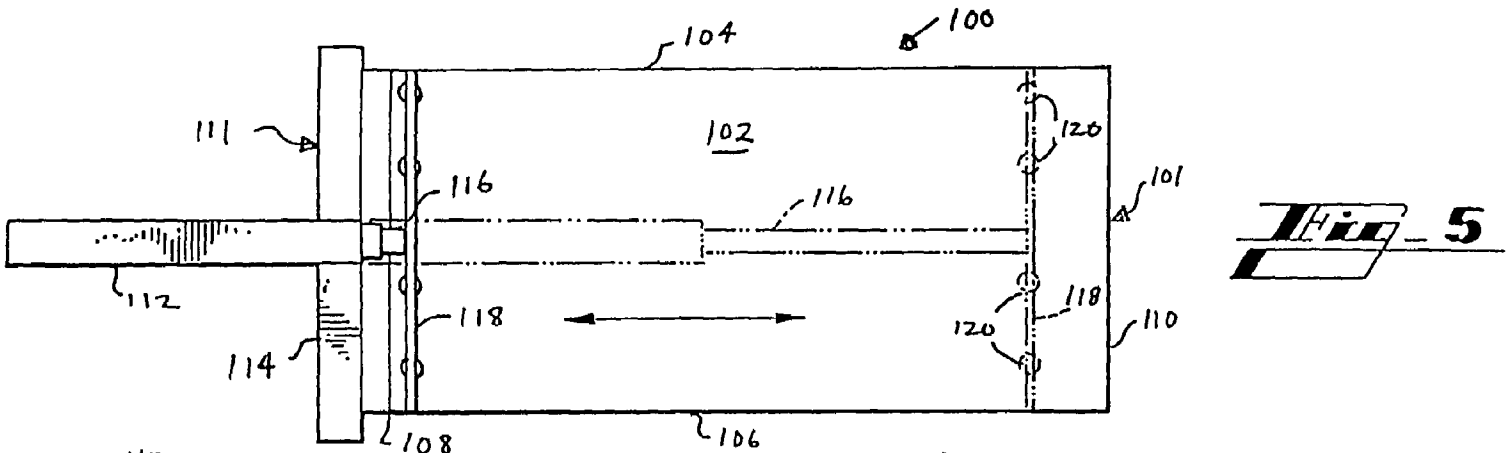
FIG. 5 is an elevation view of an alternative printing system made in accordance with an embodiment of this invention and including a telescoping sprayer actuator.
Figure 6:
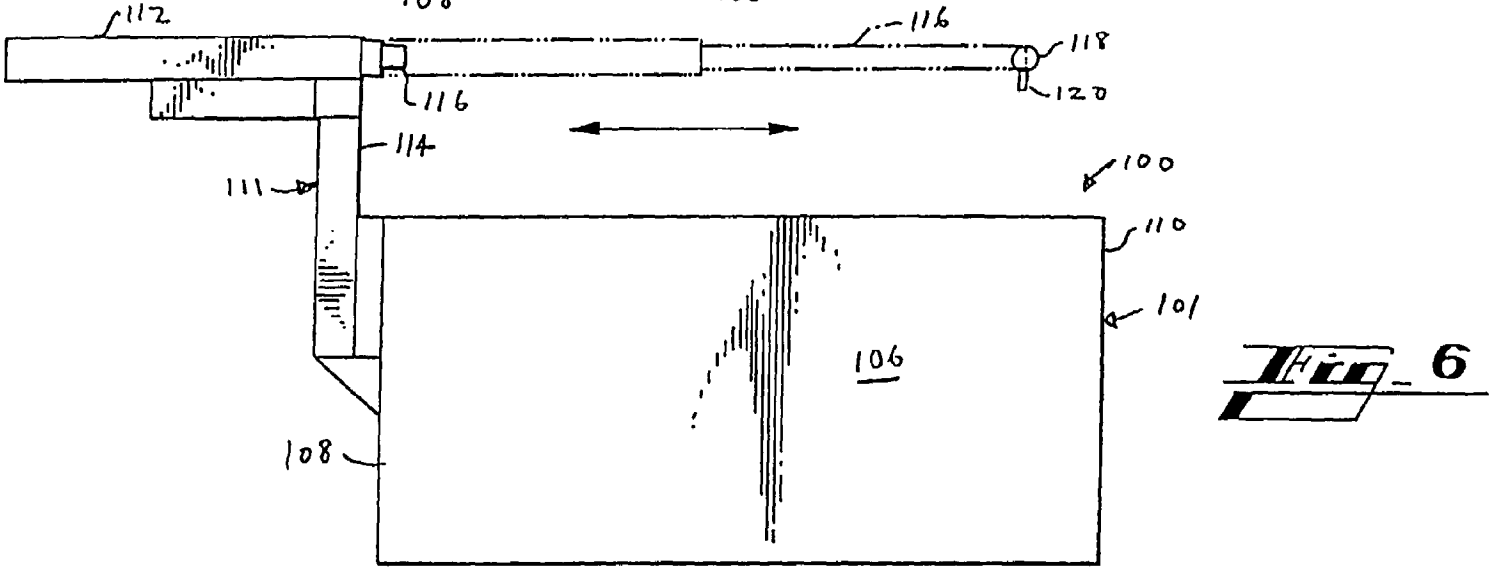
FIG. 6 is a side elevation view of the alternative printing system illustrated in FIG. 5.

FIGS. 5 and 6 illustrate a printing system 100 made according to another embodiment of this invention. This embodiment 100 comprises a support 101, which is a dipping tank for holding water 102 for supporting a sheet printed with an ink image. The tank 101 has substantially the same structure as the dipping tank 12 described in the previous embodiment. As such, the dipping tank 101 comprises side panels 104 and 106 and end panels 108 and 110. It should be understood, however, that the support surface for the printed ink image can also be a hard surface for printing methods other than transfer dip printing.

The embodiment illustrated in FIGS. 5 and 6 also includes a cantilever structure 111 mounted to one end 108 of the dipping tank 101. The cantilever comprises an actuator 112 mounted to a bracket 114 connected to the one end panel 106 of the dipping tank 101. The actuator 112 drives a telescoping rod 116 which is extendable by the actuator from one end 108 of dipping tank to the opposite end 110 of the dipping tank. A sprayer mounting member 118 is mounted to the telescoping rod 116 and carries spray heads 120. The telescoping rod 116 carries the spray heads back and forth over the dipping tank 101 for depositing activator on an ink image floating on water in the dipping tank. The operation of this alternative embodiment is the same as for the printing system 10 illustrated in FIG. 1 except for the mechanism for reciprocating the spray heads.

Figure 7:
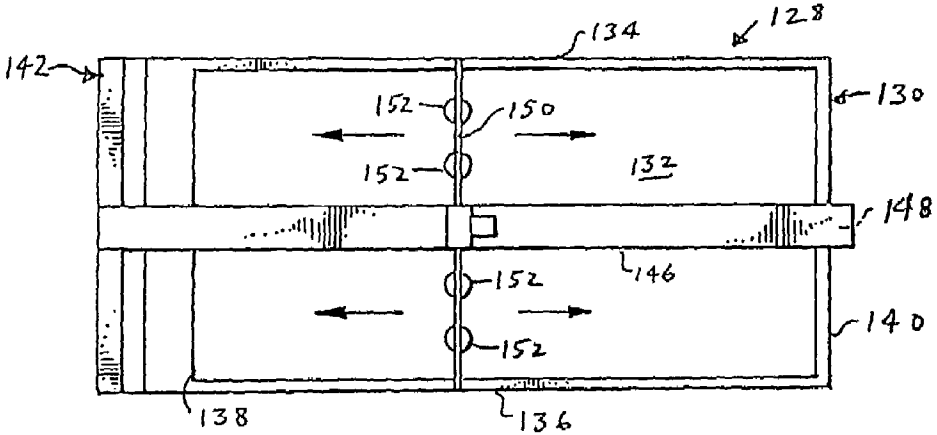
FIG. 7 is a plan view of another alternative printing system made in accordance with another embodiment of this invention.
Figure 8:
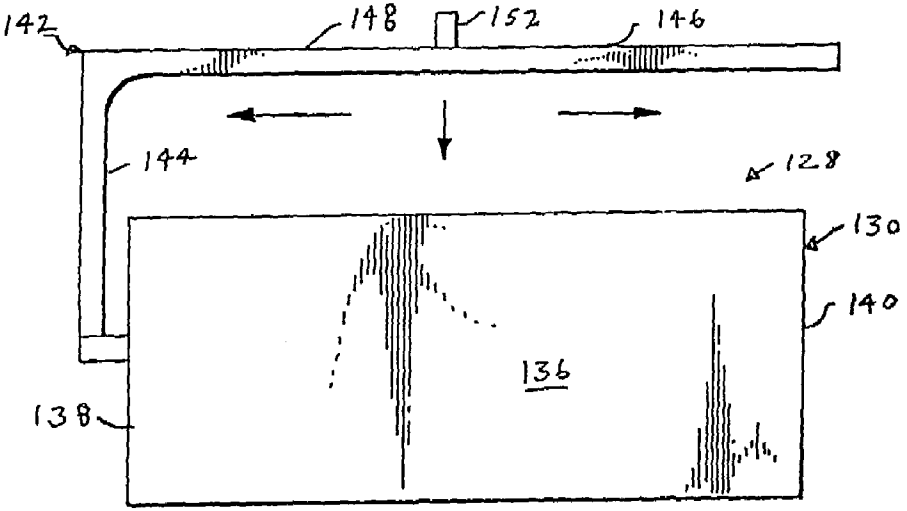
FIG. 8 is a side elevation view of the alternative embodiment illustrated in FIG. 7.

A printing system 128 made in accordance still another embodiment of this invention is illustrated in FIGS. 7 and 8. This printing system 128 has the same structure and operation as the system 10 illustrated in FIG. 1 with some exceptions as described below.

The printing system 128 illustrated in FIGS. 7 and 8 comprises a dipping tank 130 for holding water 132 for supporting sheets of water soluble film printed with organic solvent based ink. The dipping tank 130 is rectangular in cross-section and comprises side panels 134 and 136 and end panels 138 and 140. A cantilever 142 comprises a mounting member 144 mounted to one end panel 138 of the dipping tank 130 and a projecting member 146 extending from the mounting member over the dipping tank 130. The projecting member 146 comprises a rodless pneumatic cylinder 148 which extends along the length of the dipping tank 138 between the side panels 134 and 136 of the dipping tank. A sprayer mounting member 150 is mounted on the rodless cylinder 148 and a plurality of spray heads 152 are mounted on the sprayer mounting member. The rodless pneumatic cylinder 148 drives the sprayer mounting member 150 and the spray heads back and forth along the projecting member 146 while the spray heads deliver liquid activator to the ink images floating on the water in the dipping tank 130.

It should be understood that the foregoing relates to the particular embodiments of the present invention, and that numerous changes may be made therein without departing from the scope of the invention as defined by the following claims.

What is claimed is:

1. A printing system for printing an image with ink activated with a liquid activator, the printing system comprising:

a support for holding a sheet printed with the ink image, the support comprising a tank for holding a dipping liquid such that the printed sheet can float on a surface of the dipping liquid;

a cantilever comprising a mounting member and a projecting member extending from the mounting member to a distal end;

an activator sprayer mounted to the projecting member; and a reciprocator for shifting the sprayer back and forth over the support so that the activator can be sprayed on the ink image with the activator sprayer while the the ink image floats on the surface of the dipping liquid.

2. A printing system as in claim 1 wherein the reciprocator shifts the cantilever back and forth.

3. A printing system as in claim 2 wherein the reciprocator comprises a track and a carriage engaged with the track and connected to the mounting member of the cantilever such that the carriage can travel back and forth on the track while carrying the cantilever.

4. A printing system as in claim 3 wherein the reciprocator further comprises a driver for moving the carriage back and forth on the track.

5. A printing system as in claim 3 wherein the track extends along a side of the tank such that the projecting member of the cantilever extends across the tank toward another side of the tank.

6. A printing system as in claim 3 wherein the sprayer comprises a plurality of spray heads spaced from one another along the projecting member.

7. A printing system as in claim 1 wherein the projecting member is a telescoping rod and the reciprocator comprises an actuator for selectively expanding and alternatively contracting the telescoping rod and thereby shifting the sprayer back and forth over the support.

8. A printing system as in claim 5 wherein the support comprises a tank for holding a dipping liquid such that the printed sheet can float on a surface of the dipping liquid while the sprayer sprays activator on the ink image, the support member is disposed adjacent one end of the tank, and the telescoping rod extends across the tank toward another end of the tank.

9. A printing system as in claim 7 wherein the sprayer comprises a sprayer mounting member mounted to the telescoping rod and a plurality of spray heads spaced from one another along the sprayer mounting member.

10. A printing system as in claim 9 wherein the sprayer mounting member extends substantially perpendicularly to the telescoping rod.

11. A printing system as in claim 1 wherein the projecting member has a track extending along the length of the projecting member and the reciprocator comprises a carriage connected to the sprayer and engaged with the track such that the carriage can travel back and forth on the track while carrying the sprayer.

12. A printing system as in claim 11 wherein the support comprises a tank for holding a dipping liquid such that the printed sheet can float on a surface of the dipping liquid while the sprayer sprays activator on the ink image, the support member is disposed adjacent one end of the tank, and the projecting member extends across the tank toward another end of the tank.

13. A printing system as in claim 11 wherein the sprayer comprises a sprayer mounting member mounted to the projecting member and a plurality of spray heads spaced from one another along the sprayer mounting member.

14. A printing system as in claim 13 wherein the sprayer mounting member extends substantially perpendicularly to the projecting member.

15. A printing system as in claim 1 wherein the reciprocator is pneumatically driven.

16. A printing system as in claim 1 wherein the support comprises a table having a hard surface for holding the printed sheet.

17. A printing system as in claim 1 wherein the sprayer comprises a plurality of spray heads.

18. A transfer printing system for printing an image with ink activated with a liquid activator, the printing system comprising:

a tank for holding water such that a sheet printed with the ink image can float on a surface of the water;

a cantilever comprising a mounting member and a projecting member extending over the tank from the mounting member to a free distal end;

an activator sprayer mounted to the projecting member; and a reciprocator for shifting the sprayer back and forth over the tank so that the activator can be sprayed on the ink image with the activator sprayer while the water in the tank holds the ink image.

* * * * *